US006145276A

United States Patent [19]

Palm et al.

[11] Patent Number: 6,145,276

[45] Date of Patent: Nov. 14, 2000

[54] METHOD AND DEVICE FOR STERILIZING FOOD PACKAGING CONTAINERS

[75] Inventors: Magnus Palm, Tokyo; Michio Goto, Ota-ku; Shunsuke Yoshiyasu; Masayoshi Sugiura, both of Yokohama, all of Japan

[73] Assignee: Tetra Laval Holdings & Finance S.A., Pully, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 09/155,355

[22] PCT Filed: Mar. 27, 1997

[86] PCT No.: PCT/US97/04931

§ 371 Date: Apr. 29, 1999

§ 102(e) Date: Apr. 29, 1999

[87] PCT Pub. No.: WO97/35768

PCT Pub. Date: Oct. 2, 1997

[30] Foreign Application Priority Data

Mar. 27, 1996 [JP] Japan ..... 8-072255

[51] Int. Cl.[7] ..... B68B 55/04

[52] U.S. Cl. ..... 53/426; 53/167; 422/24; 422/28

[58] Field of Search ..... 53/167, 425, 426; 422/24, 28

[56] References Cited

U.S. PATENT DOCUMENTS 4,289,728 9/1981 Peel et al. .
4,375,145 3/1983 Mosse et al. .
4,979,347 12/1990 Shibauchi et al. .
5,350,568 9/1994 Tuckner et al. .

FOREIGN PATENT DOCUMENTS 0 361 858 4/1990 European Pat. Off. .
0 597 356 5/1994 European Pat. Off. .
62-4038 1/1987 Japan .
2-4621 1/1990 Japan .

*Primary Examiner*—Daniel B. Moon
*Attorney, Agent, or Firm*—Burns, Doane, Swecker & Mathis, L.L.P.

[57] ABSTRACT

A sterilizing device for thoroughly removing hydrogen peroxide from the interior of the container in a short period of time includes a sterilizing agent depositing device 19 which deposits a hydrogen peroxide-containing solution having a sterilizing affect into the interior of the container before the container is filled with a food product and a sterilizing agent removing device 23 which removes the hydrogen peroxide from the interior of the container by blowing compressed hot air into the container. The sterilizing method involves depositing a hydrogen peroxide-containing solution having a concentration in the range of 0.05–0.20 wt. % into the interior of the container before the container is filled with food product, irradiating the interior of the container with ultraviolet light after the hydrogen peroxide-containing solution is deposited in the interior of the container, and removing hydrogen peroxide from the interior of the container by blowing compressed hot air into the interior of the container.

14 Claims, 2 Drawing Sheets

METHOD AND DEVICE FOR STERILIZING FOOD PACKAGING CONTAINERS

FIELD OF THE INVENTION

The present invention generally relates to the sterilization of containers. More particularly, the present invention concerns a method of sterilizing food packaging containers that are filled with food and sealed, and a sterilizing device for sterilizing such packaging containers.

BACKGROUND OF THE INVENTION

FIG. 2 shows a conventional food packaging system of the type generally described in Japanese Patent Laid-Open Publication No. 255128/1987. As shown in FIG. 2, this packaging system 51 forms packaging containers 53 folded in a plate-like shape into bottomed containers having a bottom 53*a*. After the containers have been filled with liquid food, a seal is provided on the respective containers. The system includes a transfer conveyor that intermittently and continuously transfers the packaging containers 53 and a forming device 55 that forms folded packaging containers 53 into bottomed containers to feed them onto the transfer conveyor. A filling device 57 fills food product from above into the packaging containers 53 moving on the transfer conveyor, and a sealing device 59 seals the top of the packaging containers 53 filled with the food product. With this packaging system 51, packaging containers 53 can be continuously filled with liquid food and packaged in the sealed state.

To maintain the quality of the packaged food for a long period of time, it is known to sterilize the inside of the packaging container 53 before it is filled with food. The sterilizing agent can be hydrogen peroxide. In these systems, the hydrogen peroxide is used only for sterilization. Thus, after the hydrogen peroxide is deposited inside the packaging container 53, the hydrogen peroxide must be thoroughly removed before commencing the filling of the food product so that residual hydrogen peroxide in the container is kept below a specified value.

However, with the above packaging system 51 that forms packaging containers 53 into bottomed containers and continuously fills the container interior with food product, to increase or maximize productivity, the food product must be filled into the container in as short a time period as possible after depositing the hydrogen peroxide. Thus, a sterilizing agent removing method that can rapidly and reliably remove the deposited hydrogen peroxide is needed.

SUMMARY OF THE INVENTION

The present invention provides a sterilizing method and device which makes it possible to thoroughly and reliably remove the hydrogen peroxide in a short period of time by using a simple approach and configuration.

One aspect of the invention involves a method of sterilizing food packaging containers. The method includes depositing a hydrogen peroxide-containing solution having a concentration in the range of 0.05–0.20 wt. % into the interior of a packaging container before the container is filled with food product, irradiating the interior of the container with ultraviolet light after the hydrogen peroxide-containing solution is deposited in the interior of the container, and removing hydrogen peroxide from the interior of the container by blowing compressed hot air into the interior of the container.

Another aspect of the invention involves a sterilizing device for food packaging containers that includes a sterilizing agent depositing device for depositing a hydrogen peroxide-containing solution having a sterilizing affect into the interior of a packaging container before the interior of the container is filled with food product, an ultraviolet light irradiation device for irradiating the interior of the container with ultraviolet light after the hydrogen peroxide-containing solution has been deposited into the interior of the container, and a sterilizing agent removing device for removing hydrogen peroxide from the interior of the container by blowing compressed hot air into the interior of the container.

In accordance with the present invention, the compressed hot air is blown into the container interior to which a hydrogen peroxide-containing solution is deposited. The compressed hot air thermally decomposes the hydrogen peroxide to form water and oxygen, and rapidly vaporizes the water after decomposition. Thus, hydrogen peroxide can be thoroughly and reliably removed in a short time period through use of a simple method and construction.

By virtue of the present invention, it is possible even in the context of a packaging system that continuously fills contents into packaging containers which are intermittently and continuously transferred by a transferring device to thoroughly remove hydrogen peroxide from the container interior in a short time period so that both the productivity and food quality holding affect can be improved.

In addition, it is possible with the present invention to use the same sterilizing agent removing device with more than one type or size of packaging container while still ensuring reliable removal of the hydrogen peroxide, because the hot compressed air that is blown into the container interior can be selected to obtain a proper temperature suited for the volume of the food packaging container.

BRIEF DESCRIPTION OF THE DRAWING FIGURES

Further details and features associated with the present invention will become more readily apparent from the following detailed description considered with reference to the accompanying drawing figures in which like elements are designated by like reference numerals and wherein:

FIG. 1 is a perspective view of a packaging system using a sterilizing device in accordance with the present invention; and FIG. 2 is a perspective view of a conventional food packaging system.

DETAILED DESCRIPTION OF THE PRESENT INVENTION

Figure 1:
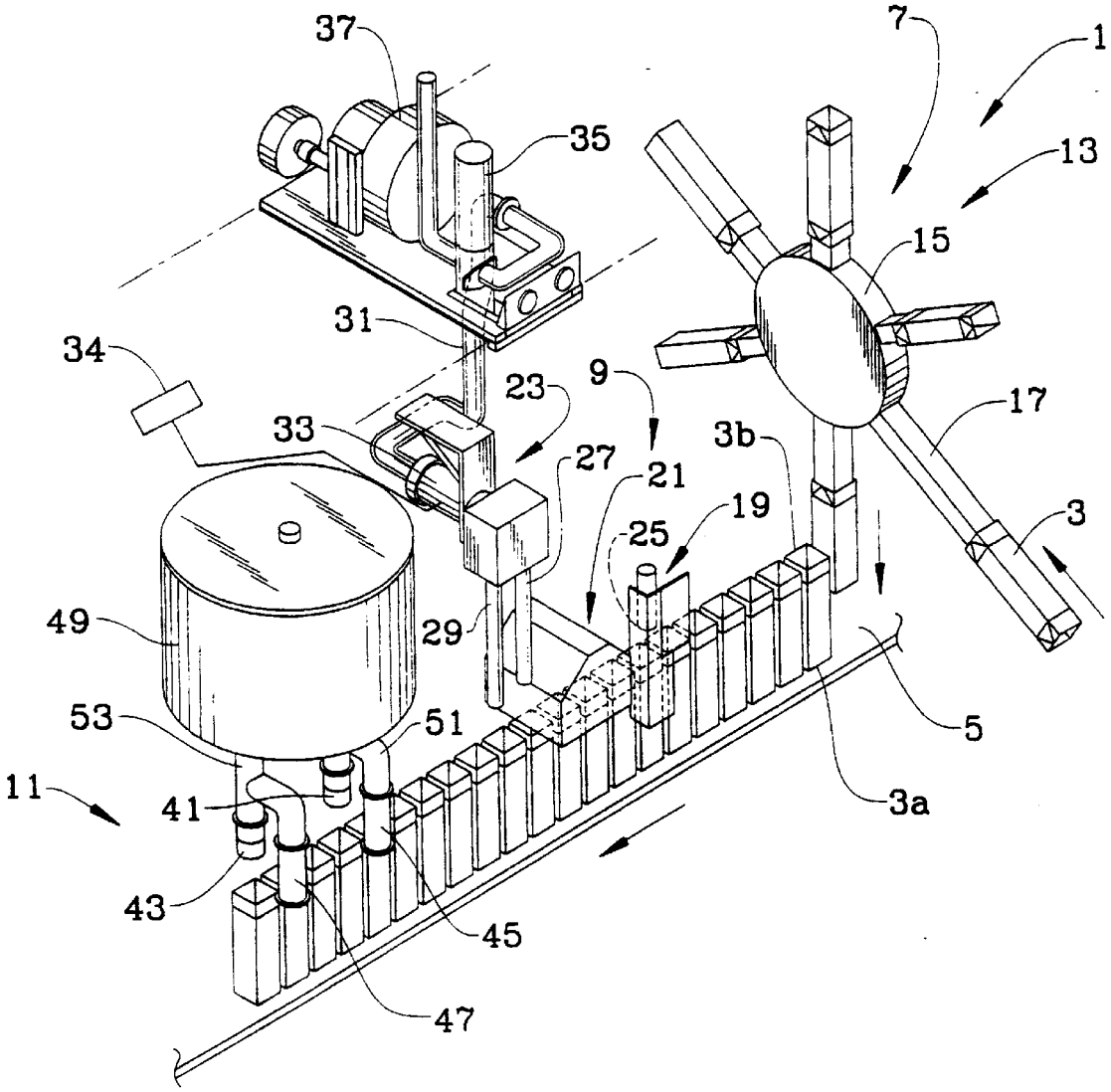
Figure 2:
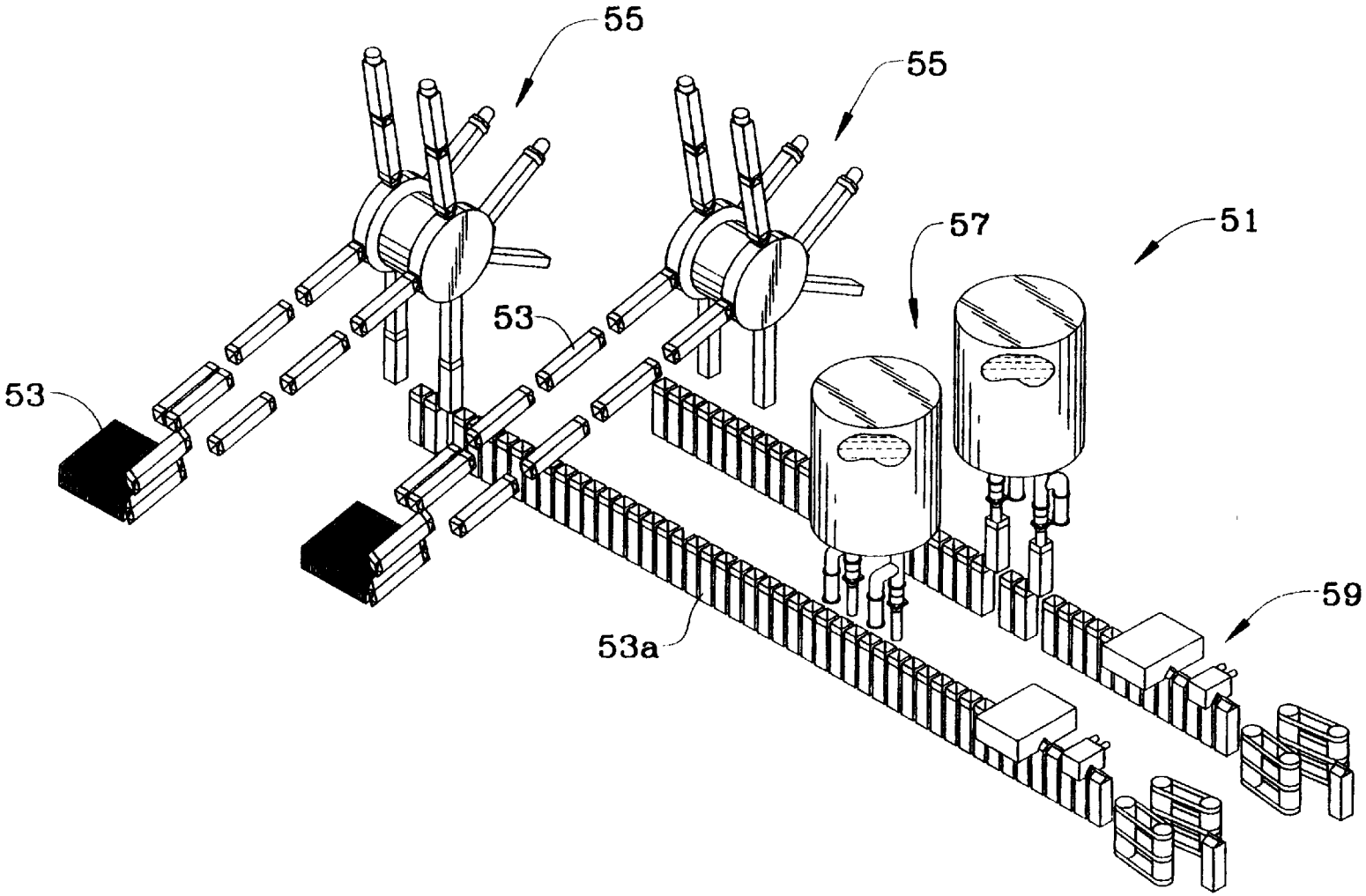

With reference to FIG. 1, the packaging system 1 of the present invention is designed to form a bottom 3*a* on a rectangular cylindrical food packaging container 3. After the container interior is sterilized, the system fills the bottomed container with contents such as a liquid food product (e.g., juice). The container is filled through the opening on the top side 3*b* of the container and the open top side of the container is then sealed. The system is equipped with a conveyor 5 that functions as a transferring device or means for intermittently and continuously carrying packaging containers 3. The driving member can be in the form of a chain or belt. A forming device 7 forms a bottom 3*a* for the rectangular cylindrical packaging container 3 and feeds the container onto the conveyor. A sterilizing device 9 sterilizes the inside of the packaging container 3 that is moving on the conveyor 5 and a filling device 11 fills the inside of the packaging container 3 on the conveyor 5 with food from above. A sealing device (not specifically shown in FIG. 1) then seals the top side 3*b* of the packaging container 3 that is filled with food.

The packaging container is made of a flexible sheet formed into an approximately rectangular tube, the sheet being made of a paper material on both sides of which a resin material is laminated. The packaging container is folded flat and is stored with other flat folded containers in a magazine. The resin material in the opening areas on both the bottom side 3*a* and the top side 3*b* of the packaging container 3 constitutes a thermoplastic layer for bonding. The packaging container 3 is provided with a plurality of fold lines to partition it into the side wall panels, the bottom wall panels on the bottom side 3*a*, and the top wall panels on the top side 3*b*.

The forming device 7 for forming the bottom of the container is provided with a mandrel wheel 13, a bottom heater (not shown), and a bottom pressing device (not shown). The mandrel wheel 13 includes a core 15 that is rotatably indexed, and mandrels 17 that are spaced around and extend radially outwardly from the core 15.

A packaging container is brought up from the magazine in the form of a rectangular cylinder having an approximately square section and is fed to the mandrel wheel 13. The packaging container is fed in the longitudinal direction, along the direction of the container axis, during loading onto the mandrel 17. When the packaging container 3 is loaded onto the mandrel 17, the mandrel wheel 13 is indexed by being turned one step, and another packaging container 3 is then loaded onto the next mandrel 17.

When the packaging container 3 loaded onto the mandrel 17 reaches the first indexing position where the bottom heater is provided, the bottom wall panels on the bottom 3*a* side of the packaging container 3 that protrude from the end of the mandrel 17 are heated by hot air heated by the bottom heater. This results in the temperature of the thermoplastic layer being raised to a softening temperature suitable for effecting sealing. Then, when the mandrel wheel 13 is indexed from the first indexing position to the next indexing position, the heated bottom wall panels are folded inwardly in overlapping relation to one another so that an approximately flat bottom 3*a* is formed.

More particularly, when the mandrel wheel 13 is indexed and the packaging container 3 reaches the indexing position at which the pressing device is provided, the bottom 3*a* is pressed and cooled by the pressing device so that the bottom panels are firmly bonded in a water-tight manner to one another through the thermoplastic layer. The result is the formation of a bottom 3*a* that is water tight and hermetically sealed.

When the mandrel wheel 13 is further rotatably indexed, and the packaging container 3 having the sealed bottom 3*a* and free from liquid leakage is brought above the conveyor 5, the packaging container 3 is pulled down in the vertical direction and placed on the conveyor 5. Located above the conveyor 5 are a top prefolder, a sterilizing device 9, a filling device 11, and a sealing device (not specifically illustrated).

The packaging containers 3 placed on the conveyor 5 from the mandrel wheel 13 are intermittently transferred in contiguous pairs, and first pass through the top prefolder (not specifically illustrated). By virtue of the operation of the top prefolder, the top wall panels on the container are slightly folded before being transferred to the sterilizing device which is positioned downstream.

The sterilizing device 9 is provided with a sterilizing agent depositing device 19, an ultraviolet light irradiating device 21, and a sterilizing agent removing device 23 that are arranged upstream of the conveyor 5 for carrying out the sterilizing process.

The sterilizing agent depositing device 19 includes sterilizing agent injection nozzles 25, each of which is located approximately above the center of the top opening in the pair of contiguous packaging containers 3 that are intermittently transferred and stopped on the conveyor 5. A sterilizing agent in the form of a hydrogen peroxide-containing solution is continuously injected into the container interior from the sterilizing agent injection nozzle 25.

The ultraviolet light irradiating device 21 includes an ultraviolet light irradiating lamp that is located above the top opening in the pair of contiguous packaging containers 3 that are intermittently transferred from the sterilizing agent depositing device 19 and stopped. The interior of the container is irradiated with ultraviolet light from the ultraviolet light irradiating lamp, which ultraviolet light has a sterilizing affect.

The sterilizing agent removing device 23 for effecting removal of sterilizing agent includes two hot air nozzles 27, 29, an air pipe 31, a heater 33, a dust removing filter 35, a flow-rate adjusting butterfly valve, and a compressor 37. The hot air nozzles 27, 29 are each located to be approximately above the center of the top opening in the pair of contiguous packaging containers 3 that are intermittently transferred and stopped on the conveyor 5. The air pipe 31 extends between and connects the hot air nozzles 27, 29 and the compressor 37. Ahead of or behind the air pipe 31 are provided the heater 33, the dust removing filter 35, and the butterfly valve. Thus, the air that is compressed by the compressor 37 and then heated by the heater 33 to raise its temperature (i.e. the hot air) is continuously blown into the container interior from the hot air nozzles 27, 29. The temperature setting for the heater 33 and the internal pressure (flow rate) for the air pipe 31 can be infinitely adjusted by operation of a controller and the butterfly valve, respectively. FIG. 1 generally illustrates a controller 34 or other suitable mechanism for effecting adjustment of the temperature of the compressed hot air that is blown into the container interior. Therefore, the temperature and the pressure (flow rate) of the hot air blown into the container interior can be set at the desired value.

The filling device 11 is provided with filling nozzles 41, 43, lifters (not specifically illustrated), metering pumps 45, 47, a tank 49, and several connecting pipes 51, 33. The filling nozzles 41, 43, the lifters, and the metering pumps 45, 47 are provided in two places, respectively. The filling nozzles 41, 43 are each located so as to be approximately above the center of the top opening in the pair of contiguous packaging containers 3 which are intermittently transferred and stopped on the conveyor 5. The lifters are provided under the bottom 3*a* of the packaging container 3, with each being positioned in opposing relation to one of the filling nozzles 41, 43, respectively. The empty packaging containers 3 transferred from the sterilizing agent removing device 23 are first lifted by the lifters to a position where the inside surface (bottom inside surface) of the bottom 3*a* of the container is nearly in contact with the filling nozzle 41, 43. At the same time, the metering pumps 45, 47 are operated to draw a predetermined amount of liquid food from the tank 49. The metering pumps 45, 47 then effect the delivery of the food product to the container. The container interior is filled with a predetermined amount of the food product through the filling nozzles 41, 43, with the lifters gradually lowering the packaging containers 3 so that the level of the food product fed into the container interior is always just under the filling nozzles 41, 43. After the predetermined amount of food product has been fed into the container interior, the lifters are completely returned to their respective initial positions, and the filled packaging containers 3 are again placed on the conveyor 5 where they are transferred to the sealing device downstream.

The sealing device is provided with a top heater and a top pressing device. The top panels of the filled packaging container 3 that is transferred by the conveyor 5 is heated by the hot air passing through the top heater so that the thermoplastic layer reaches the proper sealing temperature. The top pressing device presses the top panels to bond them to one another through the thermoplastic layer, and seals the top side 3*b* of the packaging container 3 so that a closed bottom is provided. Then, the packaging container 3 filled with food is passed through the dating device and the discharge conveyor before being delivered as a final product from the packaging system 1.

The section of the system ranging from the forming device 7 to the sealing device, including the conveyor 5, is covered with a casing (not specifically illustrated) to increase the sterilizing effect.

The results of tests that were conducted with the so-called oxidation electrode method for detecting the residue of the hydrogen peroxide after removing the sterilizing agent when the packaging system 1 equipped with a sterilizing device 9 according to the present invention will be described below.

The packaging containers 3 that were tested were bottomed type containers, having three different volumes—250 ml, 500 ml, and 1000 ml. The operating conditions set for the conveyor 5 involved: intermittently transferring packaging containers 3 in contiguous pairs in approximately 1.2 sec., and stopping them for approximately 0.6 sec. between transfers. Thus, the containers were moved forward for 0.6 sec. and then stopped moving for 0.6 sec. During the 0.6 sec. time period when the containers on the conveyor stopped moving, sterilizing agent was deposited into the containers at the sterilizing agent depositing device 19, sterilizing agent was removed from the containers at the sterilizing agent removing device 23 and liquid food product was filled into the containers at the filling device 11, respectively. Thus, each container is irradiated by the ultraviolet light irradiating device 21 for a period of time not greater than approximately 1.8 seconds. The hydrogen peroxide-containing solution that was continuously injected into the container interiors from the sterilizing agent injection nozzle 25 had a hydrogen peroxide concentration of 0.1%, and the average flow rate for the solution was 200 ml/h (for a packaging container volume of 250 ml) and 300 ml/h (for packaging container volumes of 500 ml or 1000 ml). The internal pressure for the air pipe 31 in the sterilizing agent removing device 23 was 0.2 to 0.3 bar prior to the air being passed through the dust removing filter 35 and 0.05 bar after being passed through the butterfly valve. The air flow rate was set at 80 $Nm^3/h$, and the setting temperature for the heater 33 was adjusted to the container volume of the compressor 37. The concentration of residual hydrogen peroxide was measured at six points in total, with three points inside of each packaging container 3 being sampled at random.

The results of the tests involving packaging containers 3 of 1000 ml confirmed that, when the setting temperature for the heater 33 was at 280° C. or 300° C., 0.01 ppm of hydrogen peroxide were left at three of the six measuring points. However, it was discovered that when the temperature is set at 320° C., the hydrogen peroxide was completely removed and not left at all at the six measuring points.

With packaging containers 3 of 500 ml size, it was confirmed that, when the setting temperature for the heater 33 was at 260° C., 0.01 ppm of hydrogen peroxide were left at three of the six measuring points. However, it was discovered that when the temperature is set at 280° C., the hydrogen peroxide is completely removed and not left at all at the six measuring points.

With packaging containers 3 of 250 ml size were tested, it was found that, when the setting temperature for the heater 33 is at 280° C., the hydrogen peroxide was completely removed and not left at all at the six measuring points.

From these results, it has been found that the setting temperature for the heater, when this packaging system 1 is operated under the described conditions, must be 320° C. or higher for a container volume of 1000 ml, and 280° C. or higher for 500 ml and 250 ml container volumes. By blowing the compressed hot air at such setting temperature or higher so as to be suited for the volume of the packaging container 3, the hydrogen peroxide can be thoroughly removed from the inside of the container. This is mainly because the compressed hot air blown into the container interior thermally decomposes the hydrogen peroxide in the hydrogen peroxide-containing solution deposited into the container interior to form water and oxygen, and rapidly vaporizes the water after decomposition. The reason why the proper setting temperature for 500 ml size packaging containers, which is 280° C. or higher, is the same as that for 250 ml size packaging containers is that, for the 250 ml size, the average flow rate for the hydrogen peroxide to be injected into the container interior is set at a value lower than (⅔ times) that for 500 ml.

In the context of the present invention, it was preferable to utilize a hydrogen-peroxide containing solution having a hydrogen-peroxide concentration in the range of 0.05–0.20 wt. %, preferably 0.07–0.15 wt. %.

Quite advantageously, by virtue of the present invention, if the proper setting temperature suited for the particular container volume and the operating conditions is previously determined for setting, the hydrogen peroxide can be thoroughly and reliably removed from the container interior relatively quickly. Thus, the present invention provides a simple method and device that blows compressed hot air at the proper temperature while also allowing the hydrogen peroxide to be thoroughly removed from the container interior in a short period of time.

In addition, all that is required to effect such an advantageous result is a simple and compact provision consisting of a sterilizing agent depositing device 19 that deposits a hydrogen peroxide-containing solution into the container interior and a sterilizing agent removing device 23 that removes the deposited solution by means of compressed hot air before filling the container with food.

Additionally, with the packaging system 1 that continuously fills food into packaging containers 3 which are intermittently and continuously transferred by the conveyor 5, the hydrogen peroxide can be thoroughly removed from the container interior in a short time period. Thus, even in a packaging system that continuously fills food into packaging containers which are intermittently and continuously transferred by a transferring device, it is possible to thoroughly remove the hydrogen peroxide from the container interior in a short time period so that both the productivity and food quality holding affect can be improved.

Further, hot air at the proper temperature suited for the volume of the packaging container can be blown into the container interior and the same device can be used with more than one type or size of packaging container 3 to reliably remove hydrogen peroxide.

The principles, preferred embodiments and modes of operation of the present invention have been described in the foregoing specification. However, the invention which is intended to be protected is not to be construed as limited to the particular embodiments described. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed:

1. A method of sterilizing food packaging containers that are intermittently transferred in a continuous manner, comprising:

depositing a hydrogen peroxide-containing solution having a concentration in a range of 0.05–0.20 wt. % into an interior of a packaging container before the container is filled with food product;

irradiating the interior of the container with ultraviolet light for a period of time not greater than approximately 1.8 seconds just after the hydrogen peroxide-containing solution is deposited in the interior of the container; and removing hydrogen peroxide from the interior of the container by blowing compressed hot air into the interior of the container.

2. A method of sterilizing food packaging containers according to claim 1, wherein the hydrogen peroxide-containing solution has a concentration in a range of 0.07–0.15 wt. %.

3. A method of sterilizing food packaging containers according to claim 1, wherein said compressed hot air is blown into the interior of the container at a temperature that is determined based on a volumetric size of the container.

4. A method of sterilizing food packaging containers according to claim 1, wherein the container has a volume of 1000 ml, said compressed hot air being blown into the interior of the container at a temperature of at least about 320° C.

5. A method of sterilizing food packaging containers according to claim 1, wherein the container has a volume of 500 ml, said compressed hot air being blown into the interior of the container at a temperature of at least about 280° C.

6. A method of sterilizing food packaging containers according to claim 1, wherein the container has a volume of 250 ml, said compressed hot air being blown into the interior of the container at a temperature of at least about 280° C.

7. A method of sterilizing food packaging containers according to claim 1, including changing the temperature of the hot air that is blown into the interior of the container when a volumetric size of the container being filled changes.

8. A sterilizing device for food packaging containers comprising:

a transferring device which intermittently transfers the packaging containers in a continuous manner;

a sterilizing agent depositing device which deposits a hydrogen peroxide-containing solution possessing a concentration in a range of 0.05–0.2 wt. % and having a sterilizing affect into an interior of the packaging container on the transferring device before the interior of the container is filled with food product;

an ultraviolet light irradiation device for irradiating the interior of the container with ultraviolet light for a period of time not greater than approximately 1.8 seconds just after the hydrogen peroxide-containing solution has been deposited into the interior of the container; and a sterilizing agent removing device for removing hydrogen peroxide from the interior of the container by blowing compressed hot air into the interior of the container.

9. A sterilizing device for food packaging containers according to claim 8, including a transferring device which intermittently and continuously transfers the food packaging containers.

10. A sterilizing device for food packaging containers according to claim 8, wherein said sterilizing agent depositing device continuously blows hydrogen peroxide-containing solution into the interior of the container through an open top end of the container.

11. A sterilizing device for food packaging containers according to claim 8, wherein said sterilizing agent removing device continuously blows hot air into the interior of the container.

12. A sterilizing device for food packaging containers according to claim 8, including means operatively associated with the sterilizing agent removing device for adjusting the temperature of the compressed hot air delivered to the interior of the container by the sterilizing agent removing device.

13. A sterilizing device for food packaging containers according to claim 8, wherein the sterilizing agent removing device includes a compressor and a heater connected to a pair of nozzles.

14. A sterilizing device for food packaging containers according to claim 8, wherein the sterilizing agent removing device includes a valve for adjusting a flow rate of the hot air into the interior of the container.

* * * * *